US008246330B2

(12) United States Patent
Ay et al.

(10) Patent No.: US 8,246,330 B2
(45) Date of Patent: Aug. 21, 2012

(54) INTEGRATED CATALYST

(75) Inventors: Dogan Ay, Hannover (DE); Steffen Jordan, Ronnenberg (DE); Ingo Stumberg, Hannover (DE); Herbert Schlensker, Leverkusen (DE)

(73) Assignees: Wabco Fahrzeugsysteme GmbH, Hannover (DE); Beko Technologies GmbH, Neuss (DE)

( * ) Notice: Subject to any disclaimer, the term of this patent is extended or adjusted under 35 U.S.C. 154(b) by 557 days.

(21) Appl. No.: 12/403,290

(22) Filed: Mar. 12, 2009

(65) Prior Publication Data

US 2009/0232686 A1 Sep. 17, 2009

(30) Foreign Application Priority Data

Mar. 14, 2008 (DE) ..... 10 2008 014 205

(51) Int. Cl.
*A61M 1/00* (2006.01)

(52) U.S. Cl. ..... 417/437; 417/313

(58) Field of Classification Search ..... 417/437, 417/313, 53; 62/114, 118, 149; 210/168, 210/171, 459–460, 462
See application file for complete search history.

(56) References Cited

U.S. PATENT DOCUMENTS

| | | | | |
|---|---|---|---|---|
| 5,182,086 | A * | 1/1993 | Henderson et al. | 422/171 |
| 5,284,629 | A | 2/1994 | Henderson et al. | |
| 6,669,451 | B1 | 12/2003 | Wall | |

FOREIGN PATENT DOCUMENTS

| | | | |
|---|---|---|---|
| DE | 199 02 052 | C2 | 2/2001 |
| DE | 100 08 609 | C1 | 9/2001 |
| WO | WO 00/66251 | | 11/2000 |
| WO | WO 02/060564 | A1 | 8/2002 |

* cited by examiner

*Primary Examiner* — Anne Hines
(74) *Attorney, Agent, or Firm* — McCarter & English, LLP

(57) ABSTRACT

The invention relates to an air compressor having a catalyst that is disposed in a reception block. The reception block is interposed between a valve block and a cylinder cover, comprises an inlet port in the region of a valve block outlet port, and an outlet port in the region of a cylinder head inlet port, so the compressed air exiting the valve block outlet port flows through said catalyst and through the outlet port into the cylinder cover.

15 Claims, 5 Drawing Sheets

INTEGRATED CATALYST

CROSS-REFERENCE TO RELATED APPLICATIONS

This patent application claims priority to co-pending German Patent Application No. DE 10 2008 014 205.0, filed Mar. 14, 2008, which is hereby expressly incorporated by reference in its entirety as part of the present disclosure.

BACKGROUND OF THE INVENTION

The present invention relates to an air compressor with a catalyst disposed in a reception block.

Air compressors generate compressed air by drawing and compressing ambient air. They are utilized in the industry and often also on trucks in order to provide compressed air for the brake system or for the vehicle spring or damper system. The compressed gas is thereby almost inevitably contaminated with oil aerosols and oil vapor, all the more so if the air compressors are operated with oil lubrication. Due to the small amount of leakage between pistons and cylinders, the oil aerosols and the oil vapor are transported with the supplied compressed air into the compressed air system. The amount of contamination thereby depends on the operating conditions such as temperature, compressed air volume flow or component tolerances.

For a plurality of applications, such type contamination is undesirable or even unacceptable. Presently, no compressors are known which are capable of generating oil-free compressed gases without having to additionally process them. Although compressors for oil-free compression of gas or compressed air are available, the compressed air they generate still comprises at least small amounts of, for example, organic impurities. This results, inter alia, from the fact that the compressions absorb impurities from ambient air. The oil contaminates and, as a result thereof, affects the function of the components mounted downstream thereof. When the compressed air, which has been used, is vented to the atmosphere, this also has an impact on the environment.

For this reason, one usually utilizes filter systems mounted downstream thereof which are to ensure appropriate quality of the compressed air. Substantially, absorption filters made from activated carbon are known, but they have a short life. One also utilizes the catalytic combustion of the oil contained in the compressed air, using what are referred to as oxidation catalysts. Put simply, the oil, which is contained in the compressed air in the form of hydrocarbon compounds (CH groups), is chemically broken down to carbon dioxide (CO2) and water (H2O) in an exothermic reaction. This method is in particular known from the automotive field and is utilized for both gas and diesel engines. In process engineering, oxidation catalysts are also utilized for cleaning contaminated exhausts.

U.S. Pat. No. 5,284,629 A describes a method of removing compressor oil from compressed air wherein the compressed air is led through a tank in which there is located a layer of an oxidation catalyst. Metallic components selected from the group consisting of platinum, palladium, nickel, cobalt, iron, rhodium, manganese and copper are indicated as the materials used for oxidation catalysts.

The document DE 100 08 609 C1 further describes a similar method wherein a hopcalite material is utilized as the oxidation catalyst. Hopcalite is the name for mixed oxidation catalysts mainly consisting of manganese dioxide and copper (II) oxide. They may also contain additional metal oxides such as cobalt oxide and silver (I) oxide.

The document WO 00/66251 also describes an apparatus for cleaning compressed air with the help of an oxidation catalyst mounted downstream of an air compressor.

These systems are supplied with electrical energy in order to achieve the required reaction temperature of the oxidation catalyst. Moreover, they must be disposed as additional components in the region of the air compressors, which means that they need space and mounting expense in accordance therewith. Heat exchangers are also needed as well as appropriate equipment for controlling the electronics. In particular in case of smaller amounts of compressed air, such type oxidation catalysts are disproportionally expensive.

The document EP 136 37 21, as well as the document DE 199 02 052 C2, describe the integration of oxidation catalysts in the air compressor itself. According to DE 199 02 052 C2, the oxidation catalyst is embedded in a horizontal portion of a throttle output and extends as far as the outer wall side of the cylinder head. The apparatus according to EP 136 37 21 is similar, with the oxidation catalyst being also disposed in the outlet of a cylinder. The apparatus described in these printed documents require that the oxidation catalyst material be mounted in the outlet channel. For this purpose, it is necessary to change the construction of the cylinder head or of the outlet channel since otherwise the quantity of oxidation catalyst material will not suffice. Moreover, the oxidation catalyst is difficult to maintain or replace. Finally, it seems unavoidable to rebuild the cylinder.

BRIEF SUMMARY OF THE INVENTION

It is the object of the present invention to provide an air compressor with a catalyst that reduces the oil contained in the compressed air to a very low amount. Thereby, as far as possible, the air compressor is intended to be at low cost to manufacture and to maintain. In particular, the apparatus should be of the smallest possible dimensions.

In accordance with the invention, the solution to this object is achieved with an air compressor having a catalyst disposed in a reception block, said reception block: (i) being interposed between a valve block and a cylinder cover; (ii) comprising an inlet port in the region of a valve block outlet port; and (iii) comprising an outlet port in the region of a cylinder head inlet port, so the compressed air exiting the valve block outlet port flows through the catalyst and through the outlet port into the cylinder cover.

The apparatus of the invention involves several improvements to prior art. The catalyst, preferably an oxidation catalyst, is not disposed directly in the compression chamber or in the outlet channel placed downstream thereof like in prior art, but is located in an intermediate element configured to be a reception block and located between the valve block and the cylinder head. As a result, a commercially available air compressor, preferably a piston compressor, may be readily modified for using the integrated catalyst. It is merely necessary to detach the cylinder cover from the cylinder block, to insert the reception block with the catalyst and to connect again the cylinder cover with the cylinder block. Only the screws and gaskets need to be adapted. With the appropriate gaskets, the reception block fits snugly between the existing elements of the air compressor.

As opposed to the prior art arrangement, the arrangement of the invention also involves that the already existing component parts of the air compressor will not be subjected to higher loads.

Through the proximity of the reception block to the compression chamber, the high temperatures anyway achieved by virtue of compression, are made use of for optimal operation of the catalyst. When air is being compressed, high compression temperatures of more than 300° C. occur due to the way the system operates, said temperatures being sufficient for the catalyst to react, so that additional heating is not necessary.

Preferably, the catalyst is disposed in a recess within the reception block, said recess being configured such that the space that is available with the given restrictions such as the cooling channels is made use of in the best possible way to achieve the largest possible catalyst volume.

In particular, the integration of the catalyst in an air compressor with two cylinders in a water-cooled implementation as it is usually utilized in utility vehicles is readily possible. In air cooled machines it may also be readily inserted if the reception block is devised accordingly. In case of water cooling, the water channels existing in the cylinder are laid through the reception block so that the cooling flow needs not be interrupted.

As a substrate for a catalytic active coating, one may use, for example, perforated, wound and then soldered sheet steel materials, ceramic blocks with through holes, foam-like substrate discs made from ceramic materials, wire knits of various design and/or granulates made for their major part of ceramic materials.

As a base for catalytic active coatings, one may use, for example, copper oxide, iron oxide, copper manganese oxide, palladium, platinum and/or gold.

The substrates and the catalytically active coatings are only mentioned by way of example and are not understood to limit the materials that may be utilized within the scope of the invention. The choice of the substrate and of the catalytic coating depends, in particular, on the purpose of utilization.

As a substrate, it has been found particularly advantageous to use a form-fitting, molded, sponge-like metal body coated with a catalytically active material. This construction is also extremely resistant to vibrations.

The catalyst is pressed into a recess or a groove of the reception block that is adapted to the design of the substrate. During this pressing process, the catalyst is slightly deformed so that it is firmly retained in the recess or groove. A major advantage is that the discrete component parts must not be machined with the greatest possible accuracy; it is sufficient if it is molded for coarse registration fit, which is lower cost. The reception block is then mounted, together with the fixed catalyst, with corresponding gaskets between the valve block and the cylinder cover. As already discussed, other forms of the substrate may also be envisaged; instead of the foam-like cast metal one may also use a making with several plates which are cut to shape by means of water jet or laser and which are stacked one above the other in the receiving receptacle after coating. For passage of the compressed air, such type plates may for example be made from a grid material or a knit material. Another variant consists in using granulate as the catalyst material, which is also pressed into the receiving receptacle.

Aluminum is particularly suited as a foam-like catalyst material since it is light, ductile and weldable. A braided stainless steel may also be used.

The recess in the reception block is configured to be slightly conical for ease of demolding.

It may further be envisaged to configure the reception block itself to be closed in the direction of the cylinder head except for the passageways needed for compressed air and at need for water cooling; but it may also be envisaged to use a gasket or an intermediate plate for closing the recess in the direction of the cylinder head.

The present invention will be discussed in closer detail by way of a preferred exemplary embodiment.

DETAILED DESCRIPTION OF THE INVENTION

Figure 1:
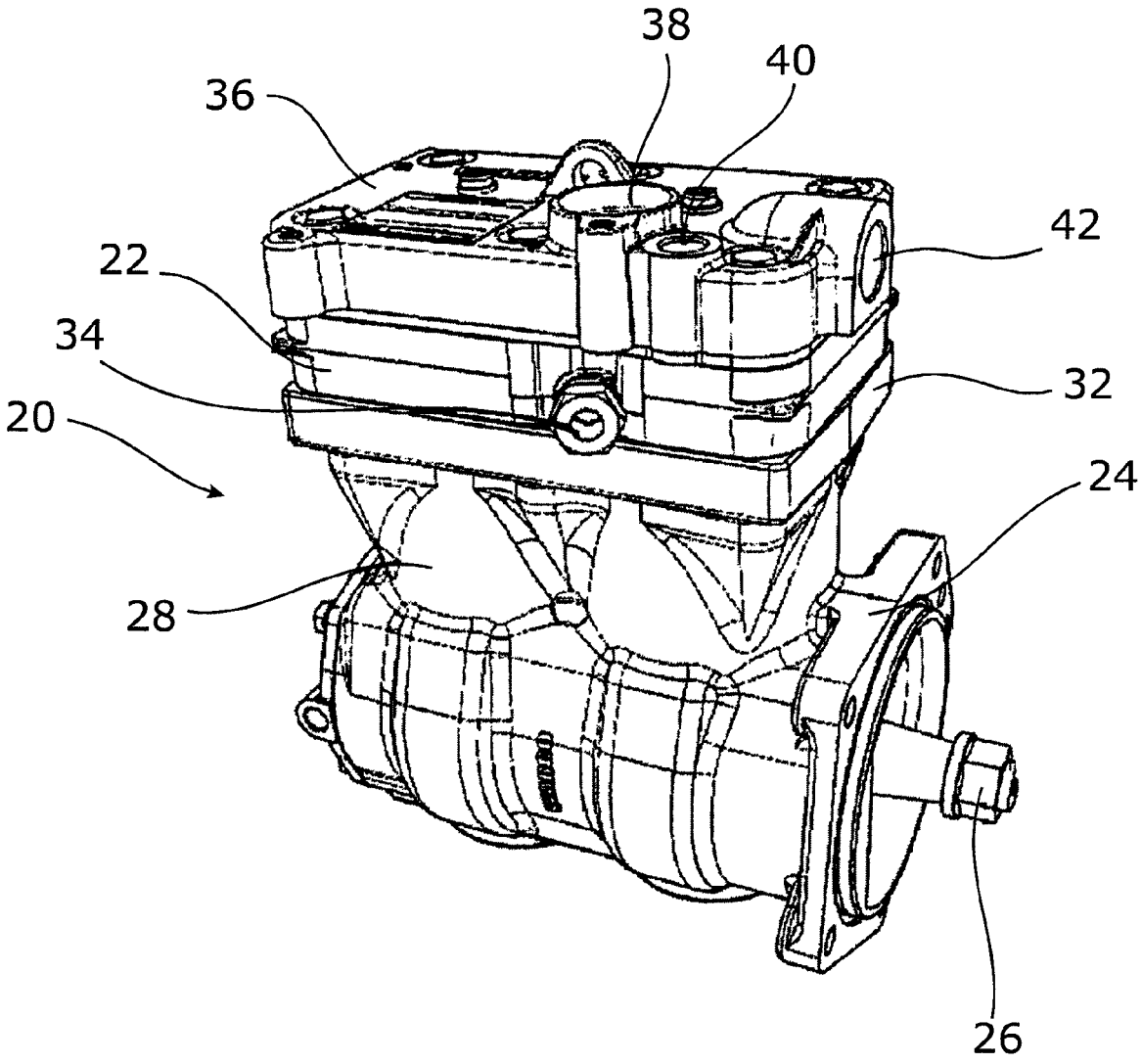
FIG. 1 shows a perspective side view of an air compressor of the invention.
Figure 2:
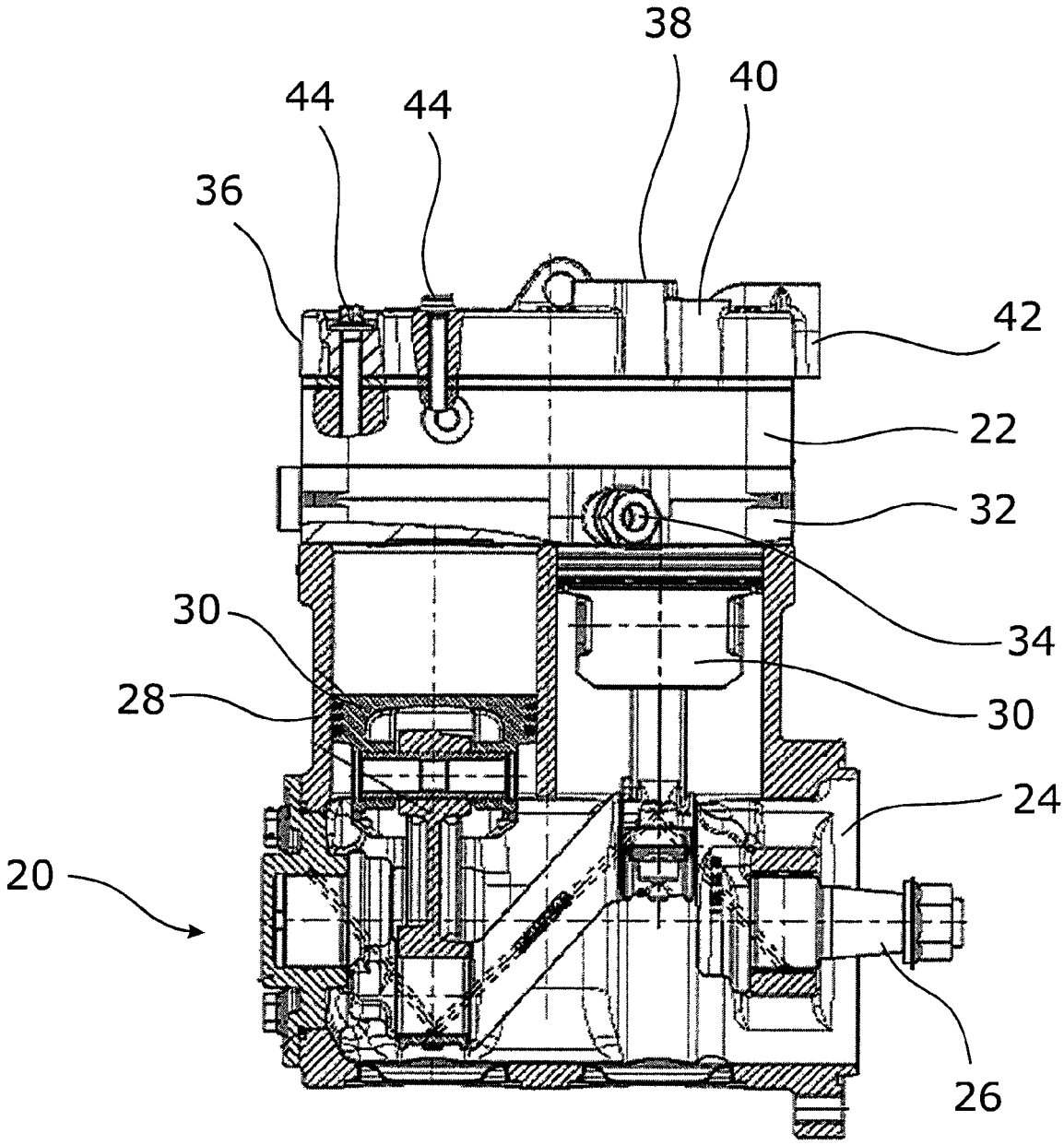
FIG. 2 shows the air compressor of FIG. 1 in a side view, in partial section.

FIGS. 1 and 2 show an air compressor 20 of the invention, in which there is integrated a reception block 23. A piston compressor is shown by way of example. A crankcase 24 is adjoined with a drive shaft to a motor that has not been illustrated herein. The crankcase 24 is adjacent a cylinder block 28. Inside said cylinder block 28 there are located two pistons 30 in the exemplary embodiment shown. On the cylinder block 28, there are further located a valve block 32 with a cooling water outlet 34. The reception block 22 is interposed between the valve block 32 and a cylinder cover 36, said cylinder cover 36 comprising an intake air inlet 38, a cooling water inlet 40 and a compressed air outlet 42. Further details of the air compressor 20 will not be discussed in closer detail herein since they correspond to commercially available air compressors for utility vehicles.

Advantageously, the reception block 22 is merely inserted between the cylinder cover 36 and the valve block 32, the air compressor 20 hardly needs to be changed or not at all. Only the screws 44 connecting the cylinder cover 36 and the cylinder block 28 must be adapted. As a result, it is possible to readily retrofit existing air compressors with the reception block 22.

Figure 3:
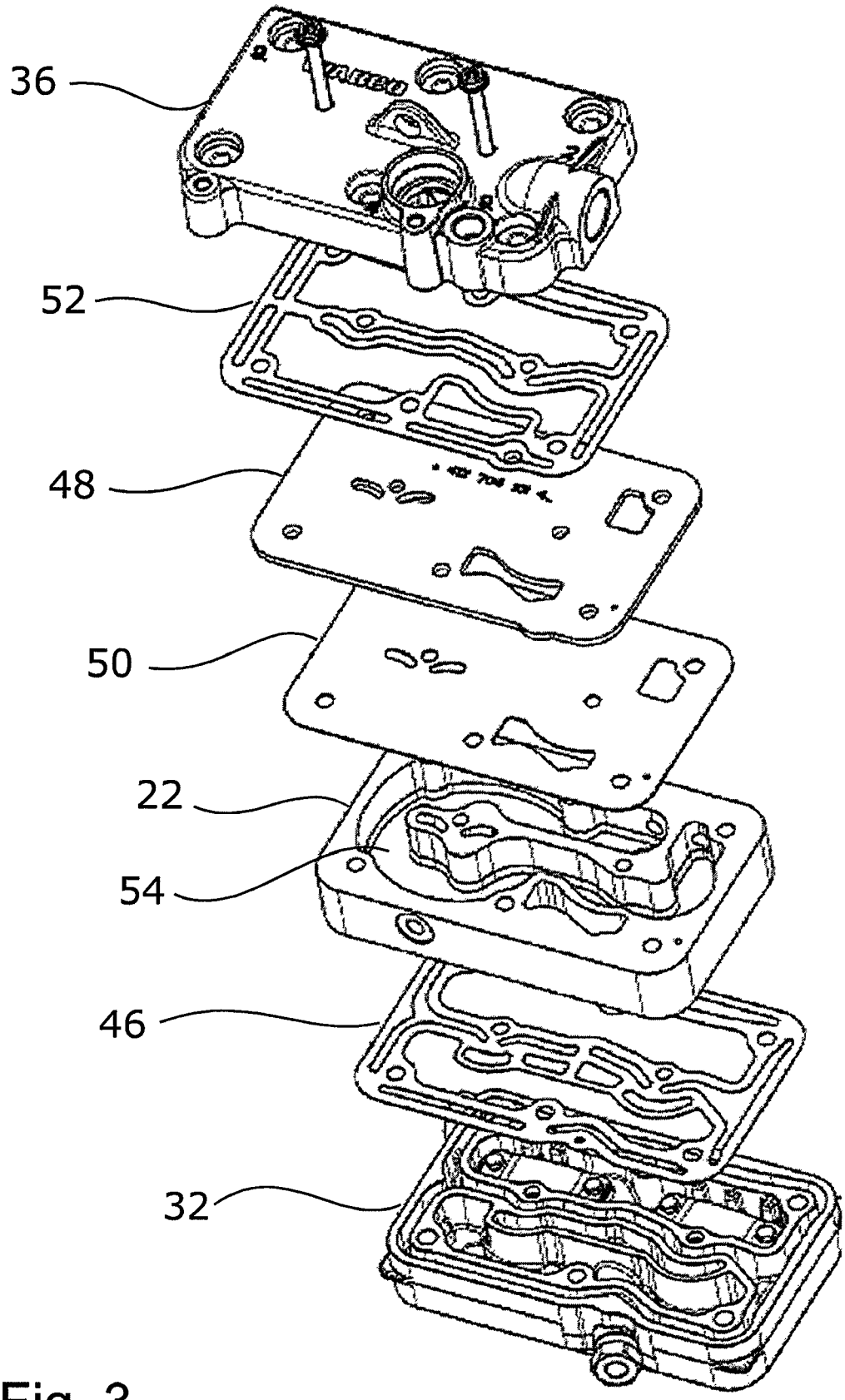
FIG. 3 shows component parts of the air compressor of FIG. 1 in an exploded view.

FIG. 3 shows the upper part of the air compressor, which is built substantially in layers, said upper part comprising the already mentioned components valve block 32, reception block 22 and cylinder cover 36. As already explained, the reception block 22 is bounded by the valve block 32 and the cylinder cover 36. Between the valve block 32 and the reception block 22 there is provided a valve block gasket 46, between the reception block 22 and an intermediate plate 48 there is provided a reception block gasket 50 and between the intermediate plate 48 and the cylinder cover 36, a cylinder cover gasket 52. The gaskets 46, 50, 52 comprise ports for feeding cooling water and compressed air therethrough.

According to an advantageous implementation of the invention, the intermediate plate 48 mentioned is provided for retaining the catalyst material in a recess 54 of the reception block 22. The reception block gasket 50 serves for sealing the recess 54.

Figure 4:
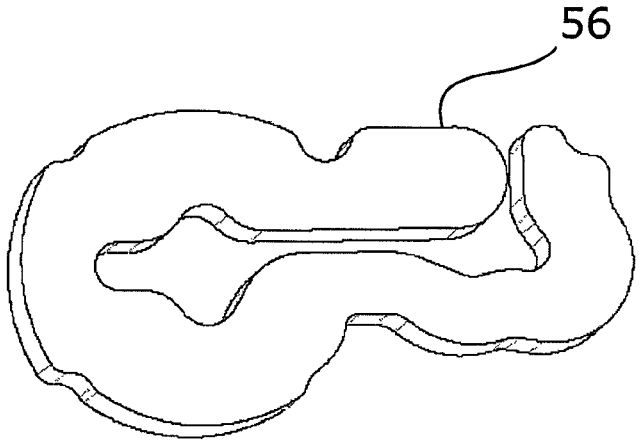
FIG. 4 shows a catalyst carrier of the invention.

A first variant of the catalyst 56 is shown in FIG. 4. In accordance with the invention, the catalyst is formed from a foam-like cast metal that is coated with a catalytically active material.

Advantageously, the course and shape of the recess 54 is adapted to the valve block 32 and to the cylinder cover 36 in a manner which makes it possible to best lead the compressed air and simultaneously the cooling water therethrough. The existing space, with its given limitations, is best made use of as a result thereof and one achieves the largest possible catalyst volume. This design may be very permissive and low cost thanks to what is referred to as primary shaping.

Figure 5:
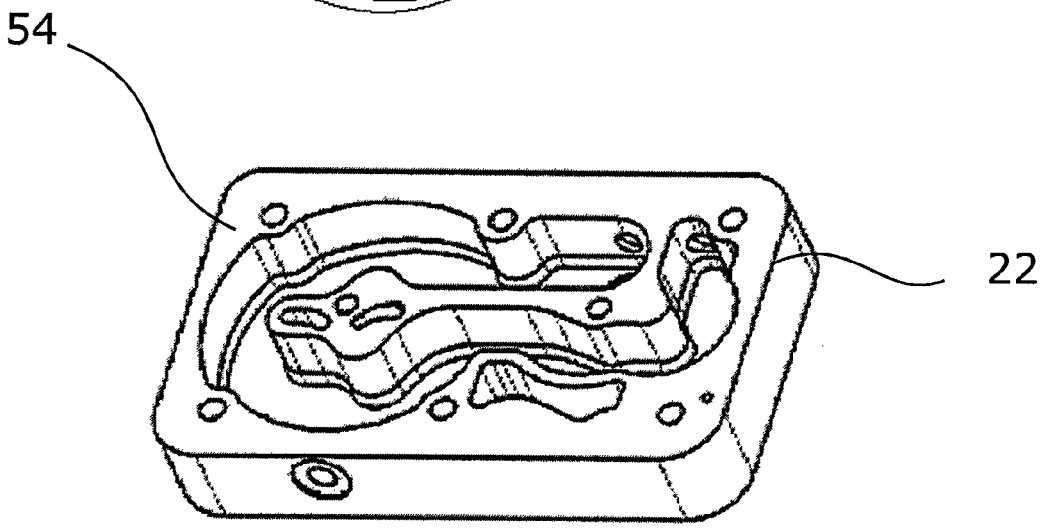
FIGS. 5 to 9 show implementations of the reception block of the invention for receiving the catalyst.
Figure 6:
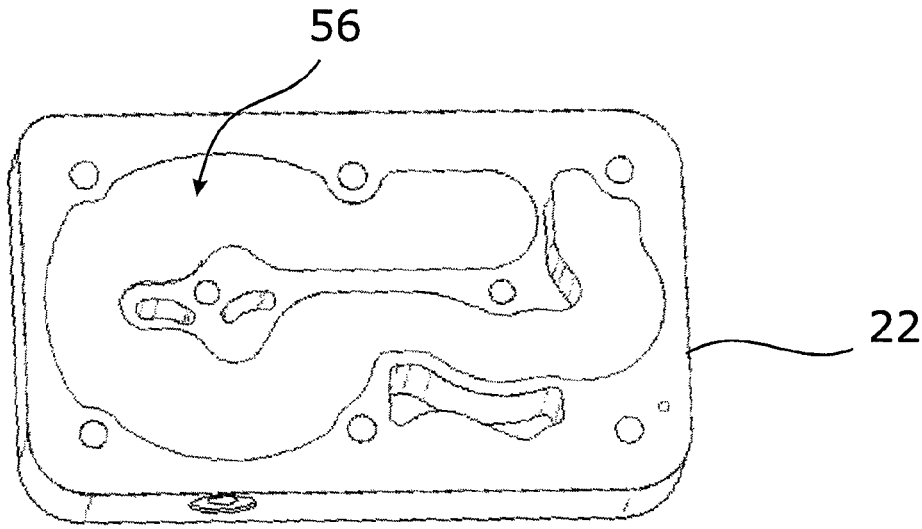

FIG. 5 shows a first embodiment of the reception block 22 with a recess 54 for receiving the catalyst material. The reception block with the catalyst material 56 disposed in the recess 54 is illustrated in FIG. 6. As can be seen, the catalyst material 56 substantially completely fills out the recess 54.

Figure 7:
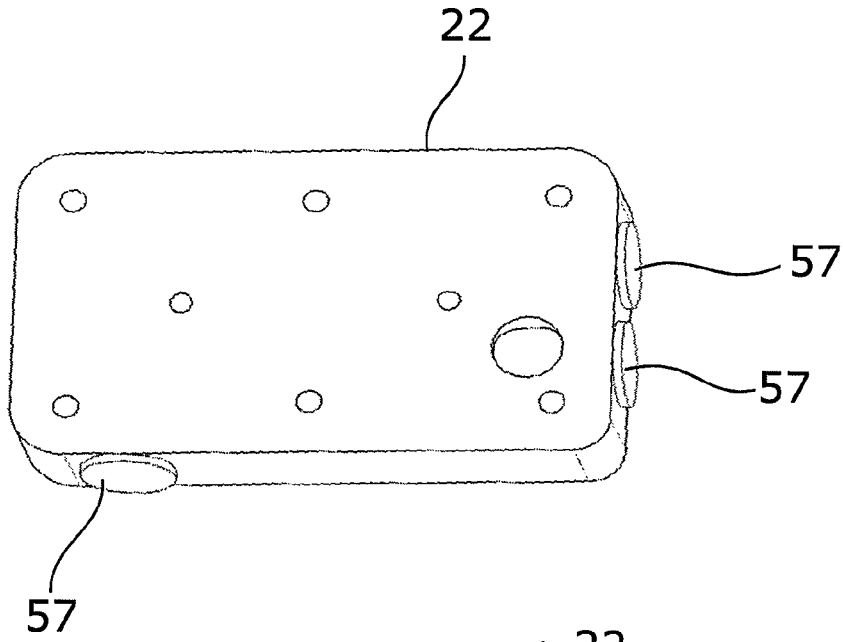
Figure 8:
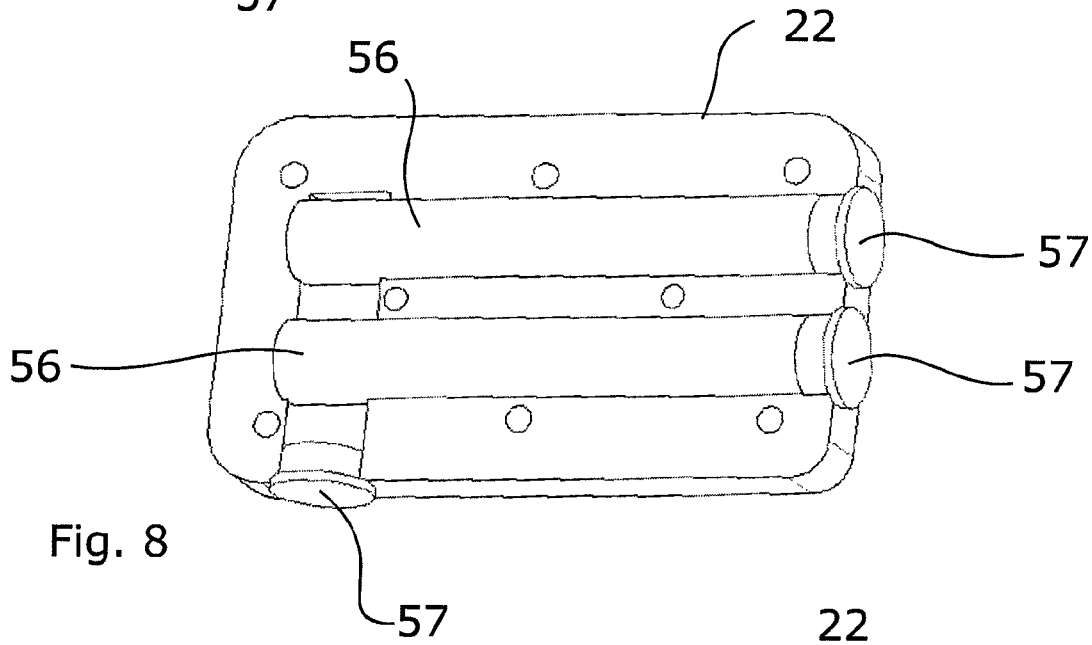

In FIG. 7, there is illustrated another embodiment of the reception block 22, which comprises recesses for rod-shaped, advantageously cylindrical, catalyst elements 56. The ports provided in the reception block 22 are closed with closing plugs 57. FIG. 8 shows the reception block 22 shown in FIG. 7 in a sectional view.

Figure 9:
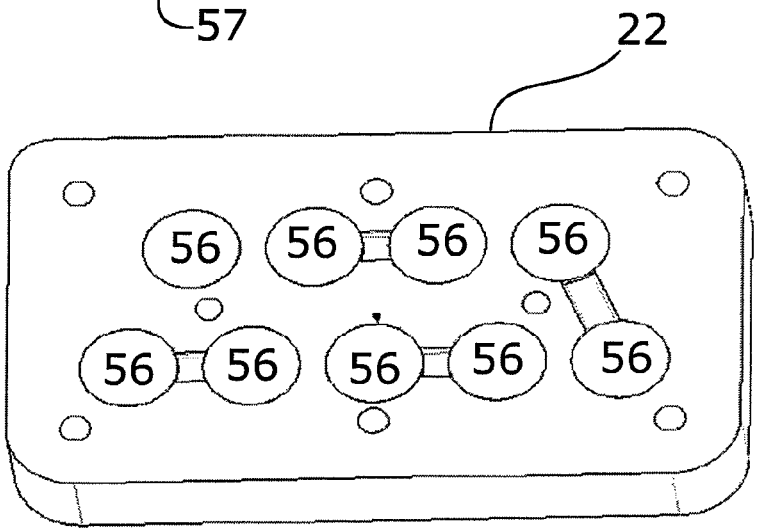

In FIG. 9, there is illustrated another embodiment of the reception block 22. In this embodiment, there are provided recesses for receiving disc-shaped catalyst elements 56.

Those skilled in the art will appreciate that the invention described herein above, and in particular in accordance with the advantageous exemplary embodiments, makes it possible to integrate a catalyst in the cylinder head of a compressor whilst optimizing the mounting space. Modular construction, which makes it possible on the one side to complement existing air compressor concepts by introducing the reception block, is hereby advantageous. Moreover, replacement of the catalyst material is made easy as one replaces the reception block. As a result, the air compressor of the invention is particularly easy to maintain.

Another advantage is obtained, which is that the catalyst material is disposed in a region of the air compressor in which the quite high air temperatures of the cylinder head are available, which increases the efficiency of the catalyst and makes the use of additional heating devices superfluous.

The invention is not limited to the exemplary embodiment described, but also includes other embodiments which will become apparent from the disclosed context.

What is claimed is:

1. An air compressor with a catalyst disposed in a reception block, said reception block being interposed between a valve block and a cylinder cover, comprising an inlet port in the region of a valve block outlet port and an outlet port in the region of a cylinder head inlet port, so that compressed air exiting the valve block outlet port flows through said catalyst and through the outlet port into the cylinder cover.

2. The air compressor as set forth in claim 1, further comprising a piston and cylinder arrangement.

3. The air compressor as set forth in claim 2, further comprising a cylinder block which comprises at least one cylinder for receiving at least one piston.

4. The air compressor as set forth in claim 3, wherein the valve block is interposed between the cylinder block and the reception block.

5. The air compressor as set forth in claim 1, wherein the reception block further comprises a recess for the catalyst.

6. The air compressor as set forth in claim 5, wherein the catalyst is pressed into the recess.

7. The air compressor as set forth in claim 6, further comprising an intermediate plate for retaining the catalyst in the recess.

8. The air compressor as set forth in claim 7, wherein the intermediate plate is located between the reception block and the cylinder cover.

9. The air compressor as set forth in claim 5, wherein the recess is configured to be conical.

10. The air compressor as set forth in claim 5, wherein the air compressor is an industrial air compressor.

11. The air compressor as set forth in claim 1, wherein the catalyst is configured to be an oxidation catalyst.

12. The air compressor as set forth in claim 1, wherein the air compressor is configured to be water cooled and existing water channels are laid through the reception block.

13. The air compressor as set forth in claim 1, wherein the catalyst is made from cast metal having a foam structure that is coated with a catalytically active material.

14. The air compressor as set forth in claim 13, wherein the catalyst is made from aluminium as the carrier material.

15. A method of providing compressed air on a vehicle comprising the following steps:

providing an air compressor with a catalyst disposed in a reception block, said reception block being interposed between a valve block and a cylinder cover, comprising an inlet port in the region of a valve block outlet port and an outlet port in the region of a cylinder head inlet port, so that the compressed air exiting the valve block outlet port flows through said catalyst and through the outlet port into the cylinder cover; and delivering the compressed air from the air compressor to the vehicle.

* * * * *